US007746264B1

(12) United States Patent
Kirtchik

(10) Patent No.: US 7,746,264 B1
(45) Date of Patent: Jun. 29, 2010

(54) LOW REFLECTANCE INFRARED CAMOUFLAGE SYSTEM

(75) Inventor: Hyman Kirtchik, Cincinnati, OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 05/924,404

(22) Filed: Jul. 11, 1978

(51) Int. Cl.
*H01Q 17/00* (2006.01)

(52) U.S. Cl. ..... 342/2; 342/3; 342/4; 342/13

(58) Field of Classification Search ..... 342/1–4, 342/12, 13, 52, 53, 175; 428/433, 539.5, 428/919; 427/160; 343/18 A, 18 E; 350/1.7
See application file for complete search history.

(56) References Cited

U.S. PATENT DOCUMENTS 2,843,500 A * 7/1958 Harman et al. ..... 428/433
3,614,188 A * 10/1971 Seeley et al. ..... 427/160 X
3,619,235 A * 11/1971 Furuuchi et al. ..... 350/1.7 X
3,682,528 A * 8/1972 Apfel et al. ..... 350/1.7
3,694,337 A * 9/1972 Kushihashi et al. ..... 428/433 X
3,733,217 A * 5/1973 Seeley et al. ..... 350/1.7 X
3,816,271 A * 6/1974 Greenberg ..... 204/51
4,924,228 A * 5/1990 Novak et al. ..... 342/2
5,627,541 A * 5/1997 Haley et al. ..... 342/1
6,909,395 B1 * 6/2005 Carpenter ..... 342/1

FOREIGN PATENT DOCUMENTS

GB 611742 * 11/1948 ..... 343/18 A

* cited by examiner

*Primary Examiner*—John B Sotomayor
(74) *Attorney, Agent, or Firm*—AFMCLO/JAZ; Thomas C. Stover

(57) ABSTRACT

An infrared camouflage coating system for application to the strategic surfaces of jet engine components comprised of a metal alloy substrate having an oxidized surface and a ferrous sulfide containing silicate glass bonded thereto.

1 Claim, No Drawings

LOW REFLECTANCE INFRARED CAMOUFLAGE SYSTEM

STATEMENT OF GOVERNMENT INTEREST

The invention described herein may be manufactured and used by or for the Government for governmental purposes without the payment of any royalty thereon.

BACKGROUND OF THE INVENTION

This invention relates to a countermeasure system for protecting jet aircraft from detection by infrared detection systems. More particularly, this invention concerns itself with a high temperature, low reflectance coating system which, when applied to the strategic surfaces of aircraft jet engine components, will effectively reduce the level of emitted energy radiating from the aircraft and render it undetectable by airborne and ground-base infrared detection systems.

Tactical aircraft are prime targets for a variety of infrared seeking missiles and other infrared detection devices. These aircraft are especially vulnerable to air launched missiles while cruising at altitude or during a low level attack. In close support missions, they are vulnerable to ground launched missiles, such as Redeye, which are capable of providing an effective defense against low flying attacking aircraft. The low cost, ease of operation and high reliability of infrared seeking missiles make them an effective threat in all categories of military tatics where aircraft are utilized.

The missile's attack capability to seek out and destroy tactical aircraft could be nullified if the intensity of the jet engine radiation could be decreased in the missile's wavelength and bandwidth of response and the emitted radiation from the engine could be shifted to wavelengths outside of the response range of the missile's detectors. In the last analysis, the reduction of an aircraft's infrared signature requires a combined effort which includes both the incorporation of an efficient cooled exhaust system and the application of an optically, chemically and mechanically stable emissive/reflective coating to the surfaces of jet engine components.

For application to aircraft using advanced jet engines, and particularly for countermeasure purposes, a judicious selection of low reflectance and low emissivity surfaces on critical engine components is required to optimize the trade-off between emission and reflection. Also, the air-breathing environment limits the utilization of previously known coatings designed for thermal control of space oriented countermeasure coating systems. The severe environmental conditions encountered during the operation of a jet engine aircraft include the influences of high temperature stress, overtemperature, erosion, impact by foreign objects and the metallurgical instability of coatings.

As a consequence, a research effort evolved in an attempt to solve the problems encountered by prior art coating systems by providing a low reflective, high temperature, camouflage, coating system which, when applied to the strategic surfaces of jet engine aircraft, will reduce effectively their level of emitted energy and render them undetectable from infrared detection devices. The diminution should be restricted to the 1 to 6 micron wavelength region while the bulk of the radiation in the other wavelength regions should be allowed to propagate freely from the aircraft.

It was found that the problems referred to above could be overcome by the application of a coating system which comprised a glass-ceramic coating having ferrous sulfide as an essential additive ingredient. The coating of this invention overcomes the problems of mechanical instability and lack of mechanical strength that was exhibited by prior art camouflage coatings. Further, the present invention provides a coating that gives emittance values greater than those obtained heretofore. The distinct advantages of mechanical and chemical stability exhibited by this invention favor the use of this coating system as an infrared suppression coating for jet engine aircraft.

SUMMARY OF THE INVENTION

In accordance with this invention it has been found that the addition of ferrous sulfide to a glass ceramic coating composition provides a coating system which, when applied to the strategic surfaces of a jet engine aircraft, will significantly suppress the infrared signature of such aircraft. It effectively reduces the jet engine emitted energy in the 1 to 6 micron wavelength region while at the same time permits the bulk of the radiation emitted in the other wavelength regions to propagate freely from the aircraft. The coating is a high temperature, low reflectance coating composed of a combination of about 2 to 10 mole percent ferrous sulfide and the balance a glass-ceramic starting material. The glass is homogeneous and designed for application to a metal substrate. The ferrous sulfide glass is applied to the surfaces of jet engines which have been previously treated by vapor or grit blasting and then oxidized. The surface treatment is undertaken only to increase the adherence of the coating to the substrate surface. The surface treatment does not contribute to the final emittance capabilities of the coating and is of no consequence in that regard.

Accordingly, the primary object of this invention is to develop a stable coating system which, when applied to the strategic surfaces of a jet engine components, will effectively reduce their emitted energy.

Another object of this invention is to provide an optically, mechanically and chemically stable coating system that will effectively camouflage jet engine aircraft against detection by infrared airborne and ground-base detection systems.

Still another object of this invention is to provide a low reflectance coating system that will operate effectively at elevated temperatures and reduce the level of radiation in the 1 to 6 micron wavelength spectrum being emitted from jet engine aircraft.

The above and still other objects and advantages of the present invention will become more readily apparent upon consideration of the following detailed description thereof.

DESCRIPTION OF THE PREFERRED EMBODIMENTS

With the above-defined objects in mind, the present invention contemplates a high temperature, low reflectance coating system that can effectively reduce the infrared signature of jet engine aircraft when applied as a camouflage coating to strategic surface of jet engine components. The coating system comprises a glass-ceramic coating to which is added from about 2 to 10 mole percent ferrous sulfide as an essential additive ingredient.

Low reflective coatings are needed for low temperature components to prevent reflectance of radiant energy emitted from hotter exhaust system components. The coating is applied to surfaces where the increase in surface emission is less than the reduction in reflections from other components. A minimum specular reflection of from 60-80° incidence at operating temperatures of from 500 to 1000° F. are needed.

In order to achieve the optimum requirements, the coating, when applied, requires a method of application which provides an intermolecular bond with the substrate surface of the engine components rather than other coating methods which involve only superimposed coatings. Generally, these components are fabricated from temperature resistant ferritic-base alloys, such as stainless steel 321 SS, or nickel-base alloys, such as Rene' 41. Consequently, the coating system of this invention was designed to maximize the compatibility of the coating composition with that of the substrate metal in order to avoid chemical and electrolytic interaction. It was found that the most feasible approach was the formation of an "in situ" coating at temperatures above the anticipated temperature and consisting of compounds of the elemental composition of the alloy.

The coating procedure first involved pretreating the substrate surface by vapor or grit blasting. The surface was then oxidized. Oxidation may be accomplished by a conventional dry oxidization technique, a wet hydrogen oxidization technique, or a combination of both techniques. The application of the glass coating of this invention over an oxidized surface gave no increased effect on the emissivity of the coated surface. It only served as a means for enhancing the adherence of the coating to the substrate surface. The "wet" oxidation was accomplished by passing hydrogen gas through water and then over the heat resistant nickel base alloys. In this way, only such elements as chromium, aluminum, and titanium oxidized, while nickel, iron, etc. remain unchanged. A "tighter" and more stable (optically and mechanically) outer layer resulted when dry oxidation was then carried out.

Samples of both substrate alloys, the uncoated 321 SS and Rene' 11 surfaces, were oxidized for comparison purposes. In each instance, the oxidation was performed as follows on sample discs:

1. Wet Oxidation—Pass hydrogen gas through water and then into a box-type furnace held at 1832° F. The dew point is held at 70° F. The discs are held in a metal tray. All samples are held at temperature for two hours. The discs are then cooled to room temperature in the wet hydrogen.
2. Dry Oxidation—Place the discs on a thin wire mesh screen (to heat up quickly) and then in a box type furnace maintained at 1832° F. and having free access to air circulation. Hold for 10 minutes, remove, and cool in air to room temperature.

TABLE I

LOW REFLECTIVITY COATINGS STUDY-
EMISSIVITY RESULTS AFTER OXIDATION OF 321 SS AND RENE' 41

| | | Method of Oxidation | | Wavelength (Microns) | | | | | | | | | |
|---|---|---|---|---|---|---|---|---|---|---|---|---|---|
| Sample | Alloy | Wet (l) | Dry (2) | 1 | 2 | 3 | 4 | 5 | 6 | 7 | 8 | 9 | 10 |
| a-1 | 321 SS | — | — | .490 | .480 | .395 | .340 | .295 | .260 | .240 | .220 | .205 | .195 |
| a-2 | " | x | x | .870 | .855 | .840 | .850 | .830 | .875 | .820 | .735 | .705 | .725 |
| a-3 | " | — | x | .780 | .760 | .700 | .650 | .595 | .510 | .510 | .505 | .520 | .425 |
| a-4 | " | x | — | .810 | .810 | .790 | .800 | .725 | .825 | .770 | .640 | .580 | .620 |
| b-1 | Rene' 41 | — | — | .470 | .465 | .385 | .330 | .295 | .265 | .235 | .220 | .200 | .190 |
| b-2 | " | x | x | .880 | .870 | .850 | .845 | .835 | .870 | .785 | .705 | .690 | .730 |
| b-3 | " | — | x | .800 | .795 | .755 | .730 | .690 | .660 | .635 | .580 | .485 | .415 |
| b-4 | " | x | — | .810 | .815 | .775 | .745 | .750 | .835 | .630 | .520 | .530 | .600 |

(1) Wet Hydrogen 1832 F./2 Hrs. 70 F. Dew Point
(2) Dry Air 1832 F./10 Min.

3. Wet and Dry Oxidation—The discs are first treated as in paragraph 1 and then as in paragraph 2.

The results of the oxidized 321 SS and Rene' 11 are shown in Table I.

The coating material of this invention is a homogeneous glass that has a high absorptivity. Groups with high intrinsic absorption, such as FeS, can dissolve in glass and form a homogeneous material. Typical compositions of the glasses contemplated by this invention are shown in Table II. These glasses are presumed to be opaque and in most cases were evaluated per se instead of on oxidized surfaces.

TABLE II

COMPOSITIONS OF HOMOGENOUS GLASSES (MOLE %)

| Compound | No. 1 | No. 2 | No. 3 | No. 4 |
|---|---|---|---|---|
| $Fe_2O_3$ | — | — | — | — |
| $TiO_2$ | — | — | — | — |
| $SiO_2$ | 60 | 60 | 79 | 68 |
| BaO | — | — | — | — |
| $B_2O_3$ | — | — | 13 | — |
| $Na_2O$ | 20 | 15 | 4 | 20 |
| CaO | 10 | 10 | — | 10 |
| $Al_2O_3$ | — | 5 | 2 | — |
| $Sb_2O_3$ | — | — | — | — |
| SnO | — | — | — | — |
| ZnO | — | — | — | — |
| FeS | 10 | 10 | 2 | 2 |
| $AuCl_3$ | — | — | — | — |
| $Ag_2O$ | — | — | — | — |

The glasses of Table II are capable of being made into ⅛ inch thick discs. The No. 1 glass was melted at 2460° F. whereas the other glasses were melted at between 2600° F. and 2680° F. A gas fired furnace was used to insure a reducing atmosphere. Abietic acid may also be added to each powder mixture in amounts from zero to about four mole percent, if desired, to maintain the reduction.

The glasses were sectioned into 59/64 inch diameter discs that were 0.125" thick. One side was then highly polished (ca. 0.5 RMS) while the other was roughened by grit blasting. The emittance values are shown in Table III. The data indicates high emittance can be achieved with the more refractory compositions containing FeS.

The No. 3 glass, typical of the homogenous glasses, was used as a coating on oxidized 321 SS and Rene' 41. Further, No. 1 glass was deposited on an unoxidized substrate. These are all covered elsewhere.

An additional set of tests was carried out with the No. 3 homogenous low transparent glass on the alloy substrates. Accordingly, they were prepared on both 321 SS and Rene' 41 discs.

The glasses were ball-milled, screened to −270 mesh, and then mixed with a solution of 100 parts amylacetate and 3 parts ethyl cellulose. It was then sprayed onto Rene' 41 and 321 SS discs to eventually yield 0.002" thick sections. These were fired as noted.

TABLE III

LOW REFLECTIVITY COATINGS STUDY - EMISSIVITY RESULTS ON HOMOGENOUS GLASSES

| Glass | Deposition | Condition | Spectral Normal Emittance % (Microns) 1 | 2 | 3 | 4 | 5 | 6 | 7 | 8 | 9 | 10 |
|---|---|---|---|---|---|---|---|---|---|---|---|---|
| No.1 | Disc (1) | Smooth (2) | .930 | .935 | .935 | .940 | .940 | .940 | .935 | .950 | .790 | .730 |
| No.1 | Disc | Rough (3) | .930 | .935 | .925 | .930 | .925 | .935 | .935 | .945 | .855 | .805 |
| No.2 | Disc | Smooth | .920 | .925 | .905 | .905 | .915 | .930 | .940 | .960 | .825 | .710 |
| No.2 | Disc | Rough | .925 | .930 | .920 | .920 | .930 | .940 | .950 | .960 | .860 | .785 |
| No.3 | Disc | Smooth | .950 | .940 | .950 | .950 | .955 | .965 | .945 | .955 | .625 | .790 |
| No.3 | Disc | Rough | .955 | .950 | .950 | .955 | .960 | .970 | .960 | .965 | .715 | .825 |
| No.4 | Disc | Smooth | .940 | .940 | .940 | .910 | .915 | .945 | .950 | .960 | .780 | .755 |
| No.4 | Disc | Rough | .930 | .935 | .950 | .950 | .950 | .955 | .955 | .960 | .870 | .855 |

(1) 0.125 Cast Discs (2) Polished to 0.5 RMS (One Side)

(3) Grit Blasted (One Side)

TABLE IV

LOW REFLECTIVITY COATINGS STUDY - EMISSIVITY RESULTS OF THE NO. 3 HOMOGENOUS GLASS ON WET OXIDIZED 321 SS AND RENE' 41 SUBSTRATES

| Alloy (1) | Glass (.002") | Spectral Normal Emittance at % (Microns) 1 | 2 | 3 | 4 | 5 | 6 | 7 | 8 | 9 | 10 |
|---|---|---|---|---|---|---|---|---|---|---|---|
| 321 SS | No. 3 (2) | .855 | .860 | .835 | .825 | .780 | .745 | .960 | .955 | .730 | .800 |
| Rene' 41 | No. 3 (2) | .910 | .910 | .895 | .8800 | .870 | .865 | .945 | .925 | .660 | .780 |

(1) Oxidation Process - Wet Hydrogen 1832° F./2 Hrs. 70° F. Dew Point (2) 1832° F., 4 Min. in Partial $N_2$Atmosphere

TABLE V

LOW REFLECTIVITY COATINGS STUDY - EMISSIVITY RESULTS OF HOMOGENOUS GLASS - NO. 1 ON UNOXIDIZED 321 SS AND RENE' 41 SUBSTRATES

| Alloy | Glass | Spectral Normal Emittance at % (Microns) 1 | 2 | 3 | 4 | 5 | 6 | 7 | 8 | 9 | 10 |
|---|---|---|---|---|---|---|---|---|---|---|---|
| 321 (1) | No. 1 | .825 | .830 | .800 | .735 | .655 | .595 | .525 | .600 | .820 | .805 |
| Rene' 41 (1) | No. 1 | .885 | .880 | .875 | .860 | .835 | .790 | .715 | .710 | .855 | .800 |

(1) 1630° F., 5 Min. 0.002" Thick on 0.050" Substrate

TABLE VI

EMMISSIVITY RESULTS AFTER 1500° F./50 HOURS AIR OXIDATION EXPOSURE OF GLASS NO. 3

| Alloy | Wet (1) | Dry (2) | Glass Coating | Exposure Condition | Spectral Normal Emittance at (Microns) 1 | 2 | 3 | 4 | 5 | 6 | 7 | 8 | 9 | 10 |
|---|---|---|---|---|---|---|---|---|---|---|---|---|---|---|
| Rene' 41 | X | — | No. 3 | Before | .905 | .905 | .890 | .890 | .910 | .935 | .940 | .960 | .655 | .780 |
| | | | | After | .815 | .870 | .880 | .890 | .925 | .945 | .975 | .930 | .445 | .805 |

(1) Wet Hydrogen 1832° F./2 Hrs. 70° Dew Point

The emittance values as sprayed and fired are also noted in Table IV. The homogenous glass No. 1 of Table II was deposited directly onto 321 SS and Rene' 41. It was ball-milled, screened, and sprayed as noted above. Finally it was then fired at 1650° F. for 5 minutes. The glass appeared somewhat grayer, perhaps due to oxidation during firing. The emittance values are noted in Table V.

A test was run to determine the effect of relatively short time exposure at 1500° F. The static oxidation test was in a muffle furnace for 50 hours. The results are noted in Table VI for the low reflectance system based on homogenous glasses. The emittance value of glass No. 3 on wet hydrogen oxidized Rene' 41 is also shown in Table VI.

The test results were very encouraging. In this instance, the emittance values were obviously acceptable. The contribution of the oxidized surface is somewhat obviously nil; it was used to obtain better adherence to the glass overlay. The slight browning of the surface may be due to oxidation of the FeS in the No. 3 glass. However, the oxidized surface may play a minor but important role when the overlay No. 3 homogenous glass is used; that is to say, if thin sections of this glass show translucency.

The homogenous glass is generally applied as a spray mix. For example, an optimized spray mix of No. 3 glass was prepared as follows. Enough −100 mesh No. 3 glass and acetate-cellulose solution to fill the spray gun container were mixed together in a glass jar and rolled on a ball mill rack. The ratio of glass to liquid was determined by the specific gravity desired. All work done in this example was with a slip having a specific gravity of 1.39 gms/cc. The ratio of glass to liquid was:

60 ml Iso-Pentyl Acetate—Ethyl Cellulose 100 gms.=No. 3 Glass −100 mesh

Rolling the mixture for 30 minutes on the ball mill rack was sufficient to produce a homogenous slip.

When the slip was thoroughly mixed it was sprayed onto a 6"×6" Rene' 41 plate with a back and forth motion with the spray gun 10"-12" away from the plates. The plates were hung vertically to dry. When dry the plates were attached to a Nichrome fixture and plunged into 1830° F. furnace chamber. Coatings from 0.002" to 0.010" were fired for one minute. Thicker coatings required longer firing times—up to six minutes. Over-firing the No. 1 glass coated samples did not produce pinholes.

With the No. 3 glass prepared and applied to Rene' 41 as described above, acceptable enamel coatings were made in thicknesses of 0.002" to 0.015". Coatings thinner than 0.002" tended to contain pinholes. Coatings thicker than 0.015" tended to be unstable. Heating the panels from both sides simultaneously allowed a faster and, in some respect, more easily controlled fluxing of the sprayed coating to take place. Thickness variations in a component structure has a marked effect on the firing schedule and probably furnace design used in the enamelling process. Clearly, glass will melt and flow quicker on component areas which are thin as compared to other thicker areas requiring larger times to come to temperature. Because it is a piece of missing datum, it was decided to determine the thermal expansivity of No. 3 glass. The thermal expansion of the No. 3 glass from room temperature to 930° F. was determined to be $6.3\times10^{-6}$ inches/inch/° F.

For spraying, a Binks Model 19V Spray Gun with a 66 PH Cap with VT Nozzle was used. All firings were carried out in a General Electric Silicon Carbide furnace having a 14"×14"×18" chamber.

Additional tests were conducted to determine the efficiency of coating small parts and then measuring the emittance at elevated temperature. 1.5"×6" panels of both 321 SS and Rene' 41 coated by the No. 3 glass system was used and the spectral normal emittance obtained at 1200° F. Absolute measurements of the emittance were made using a unique mirror method and one based directly on black body standardization.

Temperature measurements were made by thermocouple. A thermocouple is a welded junction between two dissimilar metals. Across the weld an electromotive junction exists between two dissimilar metals and this is some function of the weld's temperature. If opposite ends of the dissimilar metal wires are held at 32° F. and electrically insulated from each other, the EMF existing between the wires in this cold "junction" is a known function of the temperature of the hot (welded) junction. If the hot junction is joined to a given material surface, then the temperature of that surface can be measured at that point. In practice using premium grade wire, the accuracy of the measurement will be within one percent.

For heating the 1.5"×6" panels clamped at either end, a step-down transformer (2 KVA) with variable A.C. power output was used. The panel was inserted into the circuit as a power resistor. For purposes of stabilizing sample temperature, the cooling effect was negligible in respect to power supply variations. Water cooling was effective on the high current cables leading to the sample holder.

A cavity Blackbody Radiator was also used. This is a theoretical object that for a given temperature and wavelength interval emits energy at a rate determined by Planck's radiation formula. A blackbody radiates more power at any given temperature all wavelengths than any real body. The emittance is a ratio between this and the power radiated from a real surface for a given temperature and wavelength. In normal practice a device can be constructed that very closely approaches the blackbody emittance. A heated stainless steel tube cavity with a heavily oxidized inner surface and with a small hole drilled in its mid-section will give off nearly blackbody radiation in a direction normal from the hole.

The Indirect Mirror Method may also be used. A second approximation to a blackbody is the use of a front surface mirror momentarily placed with respect to a sample surface to form a "vee" cavity. The performance of the "vee" mirror was for the most part very similar to that of the tube cavity. The indirect method of measurement is done as follows:

1. Heat a cavity blackbody to the temperature of interest (1200° F.). Measure the true temperature of the blackbody with the thermocouple.
2. Measure the spectral radiance at several wavelengths of interest using the spectrometer and the collecting optics. Both the thermocouple and spectrometer outputs will be EMF's that are functions of blackbody temperature and spectral radiance respectively.
3. Now heat the coated sample to a nominal 1200° F. (one hour stabilization) and take the same measurements at the same wavelengths as with the blackbody.
4. Given both the blackbody's and sample's temperature in millivolts and the corresponding spectrometer's EMF's in millivolts for each of the wavelengths where data points were taken, the normal spectral emittance can be obtained by formula.

Table VII lists the specimens whose emittance values were obtained after stabilization for one hour at 1200° F. For the test, both 321 SS and Rene' 41 alloys were used. In all instances grit blasted surfaces were used. Where wet hydrogen oxidation was required, the parameters of time, temperature, and gas flow rates just previously established were employed. The glass coatings were thicker than normally applied. The

TABLE VII

EMITTANCE OF SPECIALLY COATED 321 SS AND RENE' 41 PANELS AT 1200° F. RESULTS OF MEASUREMENT BY MIRROR AND BLACKBODY METHODS

| Alloy (1) | Wet $H_2$ Oxidation | Glass Coating | Method of Measurement | Spectral Normal Emittance at Microns 2 | 3 | 4 | 5 | 5.5 |
|---|---|---|---|---|---|---|---|---|
| Rene' 41 | — | — | Mirror | .89 | .83 | .71 | .72 | .70 |
| | | | B.B. | .90 | .81 | .76 | .71 | .70 |
| 321 SS | — | — | Mirror | .92 | .85 | .81 | .74 | .74 |
| | | | B.B. | .86 | .82 | .82 | .74 | .76 |
| Rene' 41 | X(2) | — | Mirror | .95 | .89 | .81 | .80 | .75 |
| | | | B.B. | .91 | .85 | .79 | .75 | .78 |
| 321 SS | X(3) | — | Mirror | 1.0 | .97 | .94 | .94 | .91 |
| | | | B.B. | .96 | .93 | .93 | .90 | .88 |
| Rene' 41 | X | No. 3 | Mirror | 1.0 | 1.0 | 1.0 | 1.0 | 1.0 |
| | | | B.B. | .76 | .89 | .95 | .95 | 1.0 |
| 321 SS | X | No. 3 | Mirror | .92 | .93 | 1.0 | .96 | 1.0 |
| | | | B.B. | .83 | .89 | .98 | 1.0 | .98 |

(1) All samples grit blasted panels 1.5" × 6" × 0.050"
(2) All Rene' 41 wet hydrogen oxidized 1475° F./4 Hrs., Gas Flow 5 cu. ft./hr.
(3) All 321 SS wet hydrogen oxidizer 2190° F./1 Hr., Gas Flow 20 cu. ft./hr.
(4) Sample spalled after cooling to room temperature contribution of surface emittance with the overlay of No. 3 glass is negligible, the optimized wet oxidation was carried out to idealize the adherence and expansion properties of the glass.

From a consideration of the foregoing, it can be been that the present invention provides a novel camouflage coating system for protecting jet aircraft against detection by missile and ground-base infrared detection systems. This unique coating gives emittance values on the order of 0.2 or less in the important 1 to 6 micron wavelength region.

While the principles of the present invention have been described with particularity, it should be understood that various alternations and modifications can be made without departing from the spirit of the invention, the scope of which is defined by the appended claims.

What is claimed is:

1. A low reflectance, high temperature infrared camouflage coating system for application to the strategic surfaces of jet engine components in order to reduce their level of emitted energy and render them undetectable by infrared detection devices which comprises:

(a) a metal alloy substrate having an oxidized surface; and (b) a thin homogenous ferrous sulfide containing silicate glass mixture bonded to said oxidized surface.

* * * * *